United States Patent [19]

Leary

[11] 4,362,437

[45] Dec. 7, 1982

[54] APPARATUS FOR PROVIDING A LIQUID FREE WORKING ENVIRONMENT ON SUBMERGED SURFACES

[76] Inventor: Sean J. Leary, 10 Circle Ave., Larchmont, N.Y. 10538

[21] Appl. No.: 222,065

[22] Filed: Jan. 2, 1981

[51] Int. Cl.[3] ..... B63C 11/52

[52] U.S. Cl. ..... 405/188; 114/221 R; 114/227; 405/185

[58] Field of Search ..... 405/11, 186–190, 405/185; 114/227–229, 312–315, 321–325, 221 R, 51

[56] References Cited

U.S. PATENT DOCUMENTS

| | | | |
|---|---|---|---|
| 412,697 | 10/1889 | Clarke . | |
| 538,780 | 5/1895 | Holford . | |
| 681,562 | 8/1901 | Middleton | 405/186 |
| 808,638 | 1/1906 | Cunningham . | |
| 1,785,528 | 12/1930 | O'Rourke | 405/189 |
| 1,800,310 | 4/1931 | McGee | 114/323 X |
| 2,446,189 | 8/1948 | Oding . | |
| 2,536,103 | 1/1951 | Solheim | 114/323 X |
| 3,537,668 | 11/1970 | Kosmo et al. . | |
| 3,640,079 | 2/1972 | Therisien et al. | 405/189 |
| 3,857,249 | 12/1974 | Kelly et al. . | |
| 4,114,901 | 9/1978 | Pot . | |
| 4,161,155 | 7/1979 | Cloutier | 114/229 X |
| 4,175,510 | 11/1979 | Devine . | |

FOREIGN PATENT DOCUMENTS

| | | | |
|---|---|---|---|
| 1103172 | 3/1961 | Fed. Rep. of Germany | 405/186 |
| 264261 | 4/1929 | Italy | 114/227 |
| 1221773 | 2/1971 | United Kingdom | 114/227 |

*Primary Examiner*—Dennis L. Taylor

*Attorney, Agent, or Firm*—Lee C. Robinson, Jr.

[57] ABSTRACT

Apparatus for providing a substantially liquid free working environment on a submerged surface, such as the hull of a ship. The apparatus includes a liquid tight enclosure, a sealing edge located on the liquid tight enclosure for forming a liquid proof seal between the enclosure and a submerged surface, a device for altering the shape of the apparatus so that the sealing edge can form a seal with submerged surfaces of different shape, and a device for enabling manipulation of objects within the enclosure by a person located outside of the enclosure, which, in a preferred embodiment, includes a pair of gloves that extend into the enclosure. Such an apparatus can be used by securely placing it against a submerged surface, such as the hull of a ship, altering the shape of the apparatus until its sealing edge conforms with the submerged surface so as to make a liquid tight seal with it, and then filling the enclosure full of gas, such as air, until substantially all of the water has been removed from it. Once the water has been removed from the apparatus, a workman, such as a diver, can manipulate objects within the enclosure to perform work, such as the drilling of holes, on the submerged surface in a substantially liquid free environment.

27 Claims, 7 Drawing Figures

FIG. 1
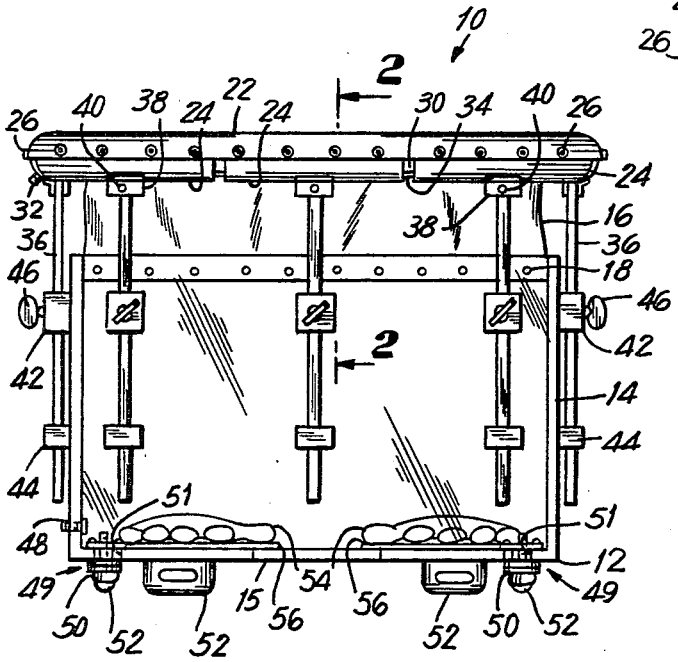
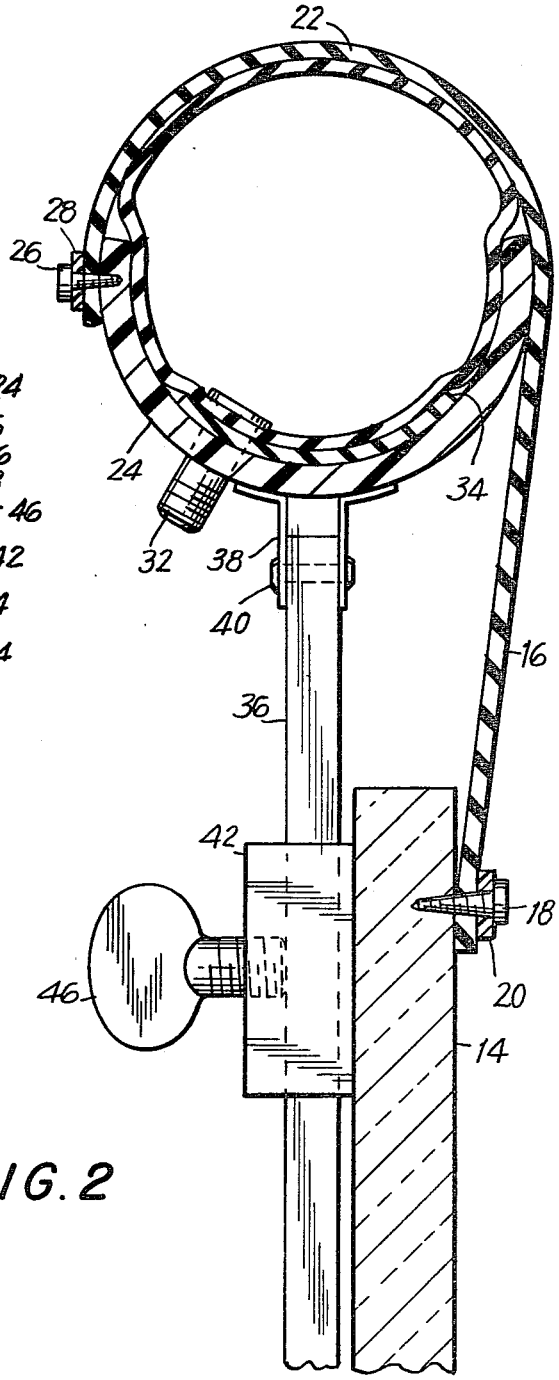
FIG. 2

FIG.5
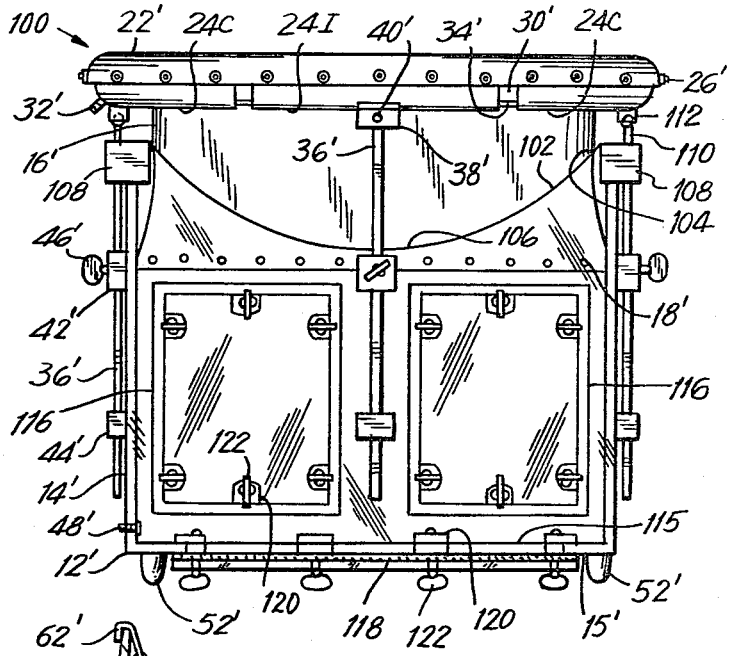
FIG.6
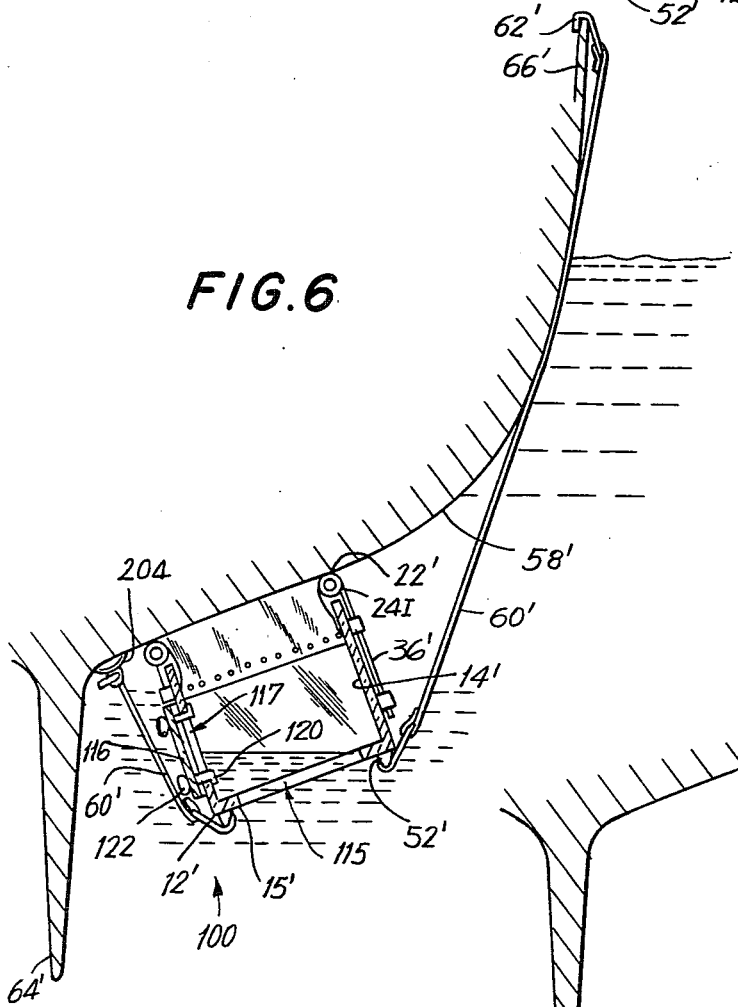
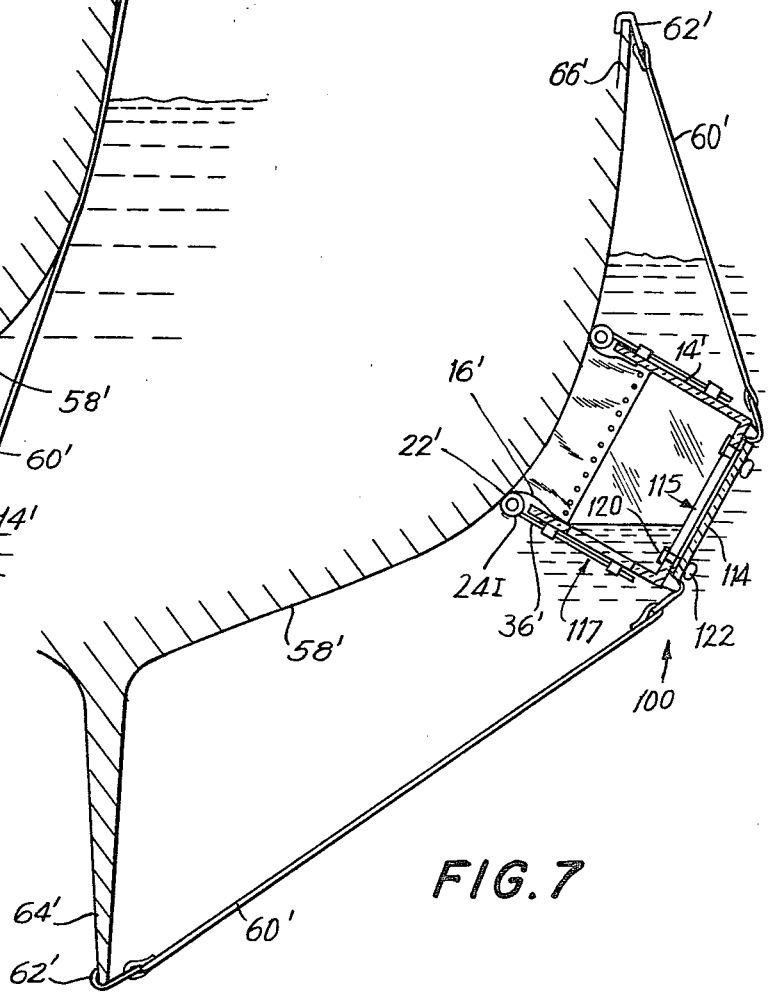
FIG.7

APPARATUS FOR PROVIDING A LIQUID FREE WORKING ENVIRONMENT ON SUBMERGED SURFACES

BACKGROUND OF THE INVENTION

1. Field of the Invention

The present invention relates generally to apparatus for providing a substantially liquid free working environment on a submerged surface, and, because of its ability to conform to underwater surfaces of different shape, it is particularly suitable for, but is not limited to, apparatus for providing substantially liquid free working environments on the submerged surfaces of ships or boats.

2. Description of the Prior Art

Devices for providing substantially liquid free working environments on submerged surfaces are well known in the prior art. For example, caissons and cofferdams have been used for years to provide substantially liquid free working environments on the submerged surfaces of ships, etc. Unfortunately most such caissons and cofferdams do not have the ability to form water tight seals with submerged surfaces of widely varying shape, such as the widely varying shapes which occur at various locations on the hulls of many boats. For example U.S. Pat. No. 808,638 issued to Cunningham displays a caisson for repairing the bottom of floating dry-docks. As is made clear from the disclosure of the Cunningham patent, its caisson is only capable of forming a water tight seal with vessels that have substantially flat bottoms. Thus, the caisson disclosed in the Cunningham patent would be largely useless for the irregularly shaped bottoms of most sailboats and other displacement type vessels.

The prior art has disclosed some devices for providing substantially liquid free working environments on submerged surfaces of varying shape, but none of these prior art devices is sufficiently inexpensive or convenient to have made its use profitable in the performing of underwater repairs or the installation of through-hull fittings in small and medium sized sailboats. For example, U.S. Pat. No. 538,780, issued to Holford discloses a caisson which can be attached to the submerged surface on one side of the hull of a sailboat at various locations along the length of that hull. But the device disclosed in the Holford patent is not very convenient to use, since it requires preformed ribs which have been shaped to fit exactly each portion of the hull to which it can be attached. Furthermore it requires that the caisson be substantially re-built each time it is moved to a different location upon the hull, and it requires that the whole caisson assembly be bolted to the side of the ship.

Another problem found with prior art devices for providing liquid free working environments on submerged surfaces is that they fail to provide means for enabling one located outside of such liquid free environment to perform work within them. Thus if it is desired to perform work in a liquid free environment upon an underwater surface with devices of the prior art it is necessary either to have the caisson or cofferdam large enough to have a person placed within it to perform such work, or, in case of a submerged surface which has liquid on only one of its sides, to make a hole through that portion of the submerged surface which is covered by a cofferdam to enable work to be performed on the covered surface from its dry side through such a hole.

Caissons which are large enough for a human worker to fit within them are, because of their size, expensive and difficult to handle. No convenient means has been found for enabling such large caissons to form liquid tight seals with underwater surfaces of varying shapes. Furthermore, such caissons can be a safety hazard, since if they flood, they can trap and drown a worker caught within them.

Cofferdams can be used to cover a portion of the liquid facing side of an underwater surface which has liquid on only one side to enable work, such as the drilling of holes, to be performed from that surface's dry side. However, the types of work which can be performed on the liquid facing side of submerged surfaces from their dry side is limited. For example, the installation of many through-hull fittings in sailboats cannot be performed solely from the inside of the hull, because the holes in which such through-hull fittings are placed normally have a bevelled edge on the exterior of the hull, making such holes wider on the exterior surface of the hull than on the interior surface. It is very difficult to drill such a bevelled hole from the interior of the hull. Furthermore, through-hull fittings normally have a head on the exterior of the hull that is wider than the smallest diameter of the hole in which it is mounted. Thus it is impossible to install such through-hull fittings from the interior of the hull. As a result, it is presently the practice to pull small and medium sized sailboats out of the water whenever such a through-hull fitting is to be installed.

OBJECTS OF THE INVENTION

Accordingly, it is an object of this invention to provide new and improved apparatus for forming a substantially liquid free working environment on a submerged surface.

It is another object of this invention to provide such apparatus which may be used on submerged surfaces of many different shapes.

It is a further object of this invention to provide apparatus of the character indicated which enables the formation of a fluid-tight seal against a submerged surface.

It is yet another object of this invention to provide apparatus for forming a substantially liquid free working environment on a submerged surface which apparatus allows a person outside of its liquid free environment to perform work within that environment.

It is still another object of this invention to provide apparatus for forming a substantially liquid free working environment on a submerged surface which enables a person to perform work inside its liquid free environment that is relatively small, easy and safe to handle, and inexpensive.

SUMMARY OF THE INVENTION

In accordance with one aspect of this invention, the apparatus comprises a liquid impervious enclosure for defining a liquid free working environment in conjunction with a submerged surface, a sealing edge located on the enclosure for forming a liquid proof seal with the submerged surface, means for altering the shape of the apparatus so that the sealing edge can form a seal with submerged surfaces of different shape and means for enabling manipulation of objects within the liquid free environment formed by the apparatus from outside that liquid free environment.

In accordance with another aspect of this invention, the means for enabling manipulation of objects within the liquid free environment from outside that environment comprises a pair of liquid impervious gloves which extend into the enclosure of the apparatus and which form a liquid proof seal with that enclosure.

According to still another aspect of the invention the apparatus comprises a rigid liquid impervious enclosure, a sealing edge for forming a liquid proof seal with a submerged surface, a deformable liquid impervious surface forming a liquid proof barrier between the rigid enclosure and the sealing edge, a plurality of projections having ends which project away from the rigid enclosure for pushing the sealing edge against the submerged surface, means for adjustably mounting such projections so that their extent away from the rigid enclsoure can be varied, edge supporting members movably mounted on the ends of those projections for supporting portions of the sealing edge which extend between the ends of those projections, and an inflatable tube mounted beneath the sealing edge for pushing it against the submerged surface so as to form a water tight seal.

The above and other objects, features and advantages of the present invention will become more readily apparent from the ensuing detailed description of preferred embodiments thereof when read with reference to the accompanying drawings.

BRIEF DESCRIPTION OF THE DRAWINGS

FIG. 1 is a side elevational view of an apparatus for providing a substantially liquid free working environment on a submerged surface according to an illustrative embodiment of the present invention;

FIG. 2 is a partial cross-sectional view of the apparatus shown in FIG. 1 taken along the line 2—2 in FIG. 1;

FIG. 5 is a side elevational view of an apparatus for providing a substantially liquid free working environment on a submerged surface according to another illustrative embodiment of the present invention; and FIGS. 6 and 7 are schematic cross-sectional views of the apparatus shown in FIG. 5 in use upon the hull of a ship.

DETAILED DESCRIPTION OF PREFERRED EMBODIMENTS

Figure 3:
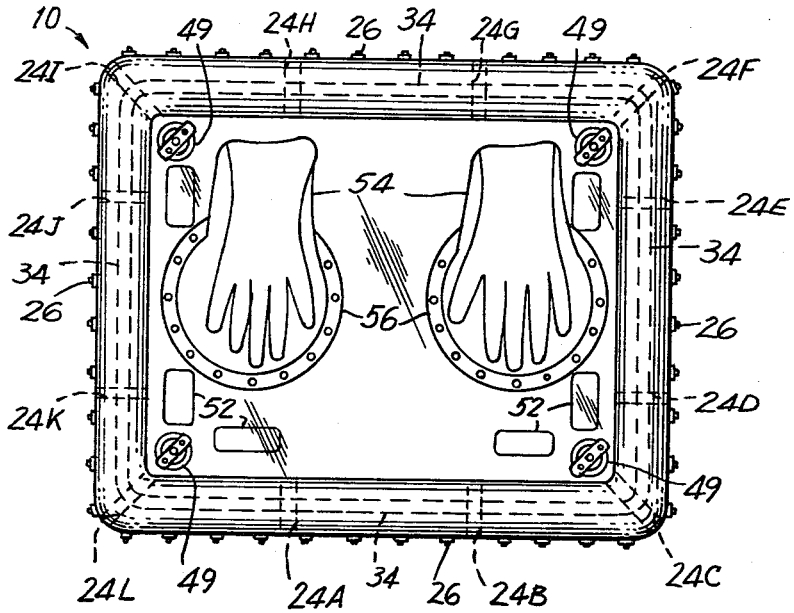
FIG. 3 is a top-plan view of the apparatus shown in FIGS. 1 and 2.

Referring now to FIGS. 1–3, an apparatus 10 for providing a substantially liquid free working environment on a submerged surface is shown which is an illustrative embodiment of the present invention. The apparatus 10 is comprised of a five-sided box 12 which is made of transparent Lexan. Lexan is a trademark of the General Electric Company for thermoplastic carbonate-linked polymers produced by reacting bisphenol A and phosgene. In alternative embodiments of the invention box 12 can be made of transparent Plexiglass, which is a trademark owned by Rohm and Haas Co. for thermoplastic poly-(methyl methacrylate) type polymers. The transparent box 12 has five liquid impervious walls, four sidewalls 14 and one bottom wall 15. The sixth side of the box is left open.

A liquid proof deformable rubber surface 16 is attached to the inside of the box 12 near the upper edges of side walls 14. As is shown in FIG. 2, the rubber surface 16 is attached to the sidewalls 14 by means of a series of screws 18 and a metal strip 20. The screws 18 push the metal strip 20 tightly against the sidewalls 14 so that the rubber surface 16 forms a liquid proof seal with the box 12.

A portion of the rubber surface 16 serves as a sealing edge 22 between the apparatus 10 and the submerged surface upon which it is to provide a liquid free working environment. The rubber surface 16 is extended up from the upper edge of the box 12 and around a semi-cylindrical edge supporting member 24 made of polyvinyl chloride, so that the rubber surface extends across the open top of the semi-cylindrical member 24, which faces in the same direction as the opening of the box 12. The rubber surface 16 is fastened to the outside edge of the semi-cylindrical supporting member 24 by screws 26 and washers 28.

As can be seen from FIG. 3, the sealing edge 22 extends all the way around the opening of the box 12. The sealing edge is supported by twelve separate edge supporting members 24, which are labelled 24A through 24L in FIG. 3. An inflatable tube 30 extends all the way around the opening of the box 12 between the sealing edge 22 and the semi-cylindrical edge supporting members 24A–24L. This inflatable tube has an air valve 32 so that it can be inflated to push up against the sealing edge 22, causing the sealing edge to conform against irregularities in a submerged surface against which the apparatus 10 is placed. A flexible rubber strip 34 is attached to the bottom of the inflatable tube 30 between that tube and the edge supporting members 24A–24L. This flexible rubber strip is fastened to the central portion of each of the supporting members 24A–24L, and it performs the function of supporting the tube 30 in the narrow spaces between those supporting members. It can be seen that the supporting members 24, the inflatable tube 30, and the rubber strip 34 form a flexible member for supporting the sealing edge 22.

Each of the supporting members 24 is attached near its central portion to a metal rod 36 by a pivotal mounting 38 and pivot pin 40. Each of the rods 36 is slidably mounted in a set of two slides 42 and 44 which are mounted in line upon the sidewalls 14 of the box 12. The uppermost slide 42 of the two slides contains a set screw 46 which can be tightened to fix the adjustable extent of its associated slidably mounted rod 36.

The box 12 contains an air valve 48 which enables compressed air to be blown into the interior of that box. The box 12 also includes four valves 49, each mounted near one of the bottom four corners of that box, for the purpose of allowing water to be blown by compressed air out of the box. Each of the valves 49 includes a screwably mounted valve seat 50 located over a valve hole 51 in the bottom wall 15. By turning the screwable valve seat, it can be either clamped tightly against the bottom wall 15 so as close the valve, or raised off the bottom wall 15 so as to open the valve.

Also located near the bottom corners of the box 12 are four strap mountings 52 which enable straps to be tied to the bottom of the box 12 so as to pull it tightly against the submerged surface on which it is to provide a liquid free working environment.

The bottom wall 15 of the box contains a pair of water impervious gloves 54, which are mounted over circular holes placed within the bottom wall 15 and which extend into the interior of the box 12. The opening of each of the gloves 54 is tightly sandwiched between the inside surface of the bottom wall 15 and a sealing ring 56, so that each glove, in conjunction with the bottom wall 15, forms a liquid tight barrier between the inside and the outside of the box 12.

Figure 4:
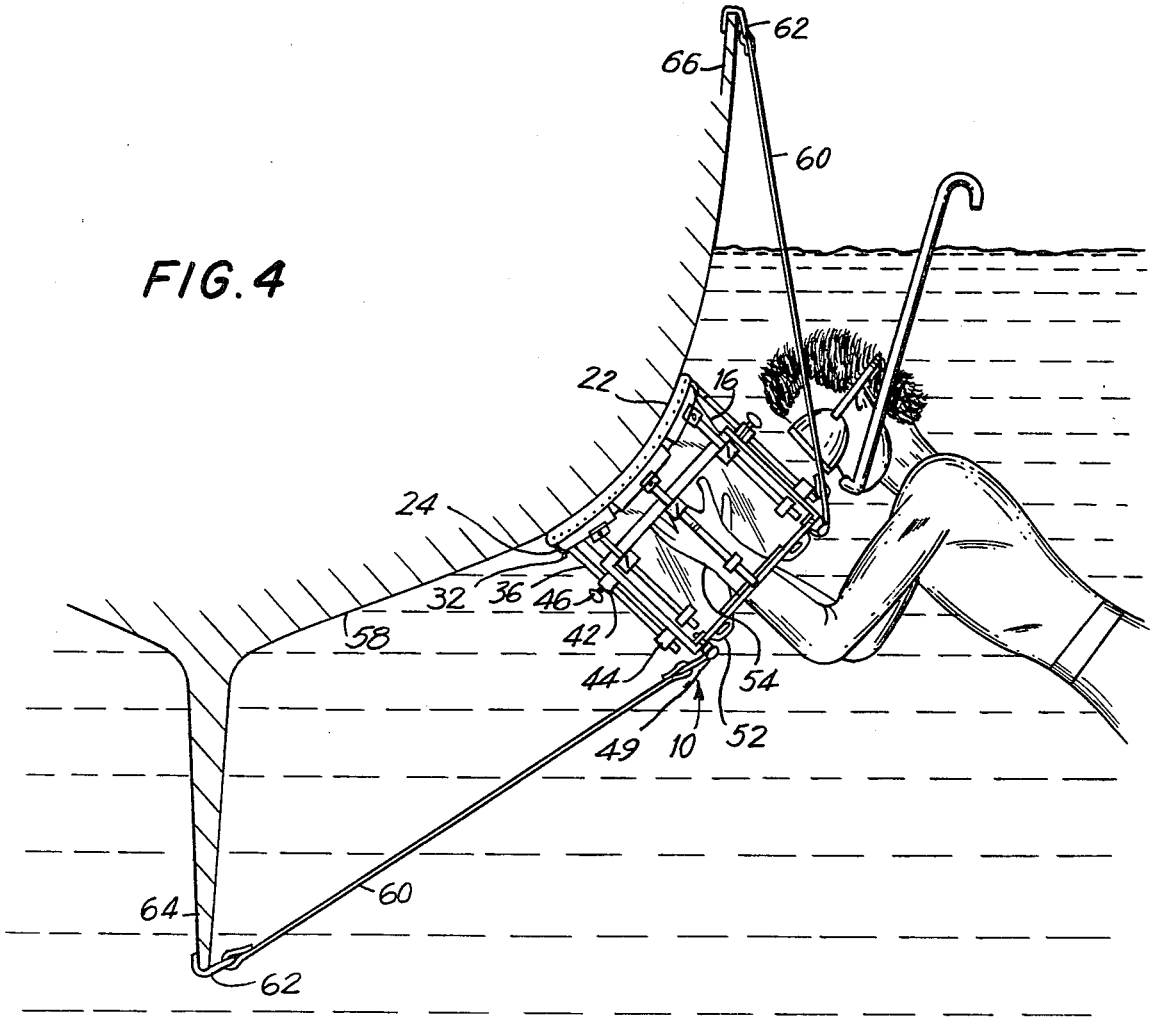
FIG. 4 is an illustration of how the apparatus shown in FIGS. 1–3 can be used to perform work upon the hull of a boat.

Referring now to FIG. 4, the operation of the apparatus 10 will be described. First the apparatus is lowered into the water and is placed against the submerged surface on which it is to provide a liquid free working environment. In the example of FIG. 4, it is placed against a submerged portion of a hull 58 of a sailboat. The apparatus should be positioned with its sealing edge 22 against the portion of the surface upon which the liquid free working environment is to be created, and, once so positioned, it should be firmly secured against that surface by means of straps 60 attached to its strap mountings 52. In the case of a sailboat, the straps 60 can have hooks 62 placed on their ends so as to firmly secure the straps 60 to the keel 64 and the rail 66 of the sailboat. The set screws 46 should then be loosened and then the slidably mounted rods 36 should be adjusted until each of the twelve edge supporting members 24 is placed against the submerged surface. Then the set screws 46 should be tightened, so as to fix each of the supporting members 24 against the submerged surface, and compressed air supplied through an air hose (not shown) from a pump located above the surface should be attached to the air valve 32, so as to inflate the inflatable tube 30 and to cause that tube to push against the entire sealing edge 22, causing the sealing to form a water tight seal against the submerged surface 58. Then the compressed air hose should be connected to the air valve 48 of the box 12. This will cause compressed air to be blown into the interior of the box 12. The lowermost of the valves 49 should be opened so that the compressed air blown into the box 12 can push the water in that box out through that lowermost valve. When substantially all of the water in the box has been removed by this method, the valve 49 which has been opened should be shut, and the compressed air hose should be removed from the air valve 48. At this point a substantially liquid free working environment will have been created within the box 12 and a person, such as the diver shown in FIG. 4, can insert his hands into the gloves 54 and perform work on that portion of the submerged surface 58 with which the apparatus 10 is sealed.

One example of many tasks for which the apparatus 10 is useful is the installation of through-hull fittings in small and medium sized sailboats. If a through-hull fitting is to be installed in the portion of the hull 58 upon which a liquid free working environment has been provided by the apparatus 10, as shown in FIG. 4, a person positioned on the interior of the boat's hull can use an electric drill to drill an initial hole through the hull 58 into the liquid free working environment created by the apparatus 10. Because the apparatus 10 forms a water tight seal with the hull 58, there is no danger that the interior of the ship will be flooded by such a hole. Once this hole has been made, the diver shown in FIG. 4 can use the rubber gloves 54 to reach for a modified rotary hole saw which has been placed in the box 12 before it was submerged for the installation of the through-hull fitting. Such a modified hole saw has its shank which is to be attached to the drill facing in the same direction as its cutting and its bevelling edges. The diver can use the rubber gloves to place the shank of the hole saw through the initial hole which has been drilled in the hull, so that the person positioned on the interior of the boat can fasten his electric drill to the shank of the hole saw and use it to create a properly sized and properly bevelled opening in the side of the hull. Then the diver can use the rubber gloves 54 to reach for a through-hull fitting which has been placed in the box 12 before it was submerged and then to feed the narrower portion of that through-hull fitting through the hole which has just been drilled. Then the person located on the interior of the boat can use a nut and a washer to securely fasten the through-hull fitting to the hull 58 so as to cause it to form a water tight seal with that hull. Thus it can be seen that the apparatus 10 prevents the need of hauling boats out of the water for the purpose of installing through-hull fittings Referring now to FIG. 5, an apparatus 100 for providing a substantially liquid free working environment on a submerged surface according to another embodiment of the present invention is shown. Elements shown in FIG. 5 which correspond to elements of apparatus 10 shown in FIGS. 1–4 have the same numbers as the corresponding elements in FIGS. 1–4 followed by a prime. The apparatus 100 of FIG. 5 is distinguished from apparatus 10 of FIGS. 1–4 by the fact that the upper edges 102 of its sidewalls 14' are concave, so that the edges 102 project highest at the corners where the sidewalls 14' meet and are recessed in their middles 106. On the uppermost portions of corners of the sidewalls 14' are located corner pieces 108 made of the same transparent material as is the box 12'. In each of the four corner pieces 108 a projection 110 is mounted, which projection forms a ball joint 112 with an associated L-shaped corner edge supporting member 24C, which supports one corner of the sealing edge 22' of the apparatus 100. The intermediate supporting members 24I which are located between corner edge supporting members 24C are connected via pivot mountings 38' and pivot pins 40' to metal rods 36', in a manner similar to that in which the edge supporting members 24 of the apparatus 10 are connected to their rods 36. The metal rods 36' are each slidably mounted in slides 42' and 44', and each slide 42' contains a set screw 46' for fixing the adjustable extent of its associated metal rod 36'. It can be seen that apparatus 100 is able to conform to both concave and convex surfaces, as is apparatus 10 shown in FIGS. 1–4, and that the apparatus 100 requires the adjustment of only four slidably mounted metal rods 36', rather than the adjustment of 12 such slidably mounted metal rods 36 as does the apparatus 10. However, it should be noted that because the apparatus 100 has only eight edge supporting members, four L-shaped corner edge supporting members 24C and four straight intermediate edge supporting members 24I, its ability to conform to irregular shapes is slightly less than that of the apparatus 10, which has twelve edge supporting members 24.

The apparatus 100 is also distinguished from the apparatus 10 by the fact that it is designed to enable manipulation of objects within the liquid free environment which it creates by means of a bottom door 114 and side doors 116, rather than by means of gloves 54 such as are used in apparatus 10. The bottom door 114 is mounted over an opening 115 in the bottom wall 15' of the box 12'. Each of the two side doors 116 is mounted over an opening 117 in one of the sidewalls 14' of the box 12'. Each of the doors has a rubber sealing edge 118 located on the periphery of its surface which faces the wall to which it attaches. This sealing edge overlaps and forms a watertight seal with the wall to which its door is attached. Each door also contains a series of clamps 120 which extend into the opening over which it is placed and overlie the opposite side of the wall in which the opening is located. Thumbscrews 122 extend through the door to each of the clamps and are designed to tighten the clamps and their associated door together and to pull their door into a liquid tight seal with the wall to which it is attached.

FIG. 6 provides a schematic cross sectional view of the apparatus 100 in use. The apparatus 100 has been placed on the underside of the hull 58' of a sailboat and has had its bottom door 114 removed. The metal rods 36' of the apparatus have been adjusted so as to cause its edge supporting members 24C and 24I to conform generally to the portion of the hull 58' to which the apparatus is attached. Then the inflatable tube 30' of the apparatus is filled with air from a compressed air hose so as to push its sealing surface 22' into a water tight seal with the hull 58'. Then air from the compressed air hose is blown up into the interior of the box 12' of the apparatus so as to force water out of that box. Because of the seal between the sealing edge 22' and the hull 58' the air which is placed in the box 12' is trapped and it prevents water from entering any higher into that box than the highest portion of the opening 115 left by the removal of the bottom door 114. Thus the apparatus 100 enables a diver to reach up through the opening 115 and perform the work in a substantially liquid free environment upon that portion of the surface 58' which is surrounded by the sealing surface 22'. It should be noted, however, that the apparatus 100 is not suitable for applications in which a hole is to be placed through the submerged surface to which it is attached, because such a hole would allow the air which is trapped within the box 12' to escape, permitting water to flood into that box and then through the hole itself.

In FIG. 6, one of the straps 60' which is used to pull the sealing edge 22' of the apparatus into a tight, liquid proof seal with the surface 58', is attached to the surface 58' by means of a suction cup 202. As is known in the art of underwater repair work, such suction cups can provide a very strong hold on the surface to which they are attached, and they enable apparatus according to the present invention to be pulled toward an underwater surface in locations in which a hook could not perform such a function.

FIG. 7 is similar to FIG. 6, except that it demonstrates that, when the apparatus 100 is placed on the side of a submerged surface, the side doors 116 can be removed, allowing access to the liquid free working environment created by the apparatus through the opening 117 left by the removal of such side doors.

The terms and expressions which have been employed in this specification are used as terms of description and not of limitations, and there is no intention in the use of such terms and expressions of excluding any equivalence of the features shown and described or portions thereof, it being recognized that various modifications are possible within the scope of the invention.

What is claimed is:

1. Apparatus for providing a substantially liquid free working environment on a submerged surface comprising:

a liquid impervious enclosure for defining said liquid free working environment in conjunction with said submerged surface;

a sealing edge located on said enclosure for forming a liquid proof seal with said submerged surface;

means cooperating with the sealing edge for altering the shape of said apparatus so that said sealing edge can form a seal with submerged surfaces of different shape; and means operatively connected with the enclosure for enabling manipulation of objects within said liquid free environment from outside said environment.

2. Apparatus for providing a substantially liquid free working environment on a submerged surface comprising:

a liquid impervious enclosure for defining said liquid free working environment in conjunction with said submerged surface, said enclosure including a rigid structure and a deformable, liquid impervious surface;

a sealing edge connected to said deformable, liquid impervious surface for forming a liquid proof seal with said submerged surface;

means for altering the shape of said apparatus so that said sealing edge can form a seal with submerged surfaces of different shape, said means including a plurality of sealing edge supporting projections mounted on said rigid structure and having ends which project away from said rigid structure for pushing said sealing edge against said submerged surface, and means for adjustably mounting at least one of said projections on said rigid structure so that the extent of its projection from said rigid structure can be varied; and means cooperating with the enclosure for enabling manipulation of objects within said liquid free environment from outside said environment.

3. Apparatus according to claim 2; wherein said rigid structure is liquid impervious and constitutes a substantial portion of the surface of said enclosure and said deformable, liquid impervious surface forms a liquid proof seal between said sealing edge and said rigid structure.

4. Apparatus according to claim 2; wherein a substantial portion of said enclosure is light transparent.

5. Apparatus according to claim 2; wherein said means for altering the shape of said enclosure further includes means for fixing the adjustable extent of said adjustably mounted projection once said enclosure has obtained a desired shape for sealing with a given submerged surface.

6. Apparatus for providing a substantially liquid free working environment on a submerged surface comprising:

a liquid impervious enclosure for defining said liquid free working environment in conjunction with said submerged surface; said enclosure including a rigid structure and a deformable, liquid impervious surface;

means for pulling said rigid structure against said submerged surface comprising at least one flexible pulling means attached at one end to said rigid structure and at the other to a hook;

a sealing edge connected to said deformable, liquid impervious surface for forming a liquid proof seal with said submerged surface;

means for altering the shape of said apparatus so that said sealing edge can form a seal with submerged surfaces of different shape, said shape altering means including a plurality of sealing edge supporting projections mounted on said rigid structure and having ends which project away from said rigid structure for pushing said sealing edge against said submerged surface, and means for adjustably mounting at least one of said projections on said rigid structure so that the extent of its projection from said rigid structure can be varied; and means cooperating with the enclosure for enabling manipulation of objects within said liquid free environment from outside said environment.

7. Apparatus for providing a substantially liquid free working environment on a submerged surface comprising:

a liquid impervious enclosure for defining said liquid free working environment in conjunction with said submerged surface; said enclosure including a rigid structure and a deformable, liquid impervious surface;

means for pulling said rigid structure against said submerged surface comprising at least one flexible pulling means attached at one end to said rigid structure and at the other to a suction cup;

a sealing edge connected to said deformable, liquid impervious surface for forming a liquid proof seal with said submerged surface;

means for altering the shape of said apparatus so that said sealing edge can form a seal with submerged surfaces of different shape, said shape altering means including a plurality of sealing edge supporting projections mounted on said rigid structure and having ends which project away from said rigid structure for pushing said sealing edge against said submerged surface and means for adjustably mounting at least one of said projections on said rigid structure so that the extent of its projection from said rigid structure can be varied; and means operatively connected with enclosure for enabling manipulation of objects within said liquid free environment from outside said environment.

8. Apparatus for providing a substantially liquid free working environment on a submerged surface comprising:

a liquid impervious enclosure for defining said liquid free working environment in conjunction with said submerged surface, said enclosure including a rigid structure and a deformable, liquid impervious surface which forms a liquid proof seal with said rigid structure;

a sealing edge connected to said deformable, liquid impervious surface for forming a liquid proof seal with said submerged surface;

means for altering the shape of said apparatus so that said sealing edge can form a seal with submerged surfaces of different shape, said shape altering means including a plurality of sealing edge supporting projections mounted on said rigid structure and having ends which project away from said rigid structure for pushing said sealing edge against said submerged surface, means for adjustably mounting at least one of said projections on said rigid structure so that the extent of its projection from said rigid structure can be varied, and a flexible member connected to said sealing edge and extending between said ends of said projections for pushing portions of said sealing edge which extend between said ends against said submerged surface; and means cooperating with the enclosure for enabling manipulation of objects within said liquid free environment from outside said environment.

9. Apparatus for providing a substantially liquid free working environment on a submerged surface comprising:

a liquid impervious enclosure for defining said liquid free working environment in conjunction with said submerged surface, said enclosure including a rigid structure and a deformable, liquid impervious surface;

a sealing edge connected to said deformable, liquid impervious surface for forming a liquid proof seal with said submerged surface;

means for altering the shape of said apparatus so that said sealing edge can form a seal with submerged surfaces of different shape, said shape altering means including a plurality of sealing edge supporting projections mounted on said rigid structure and having ends which project away from said rigid structure for pushing said sealing edge against said submerged surface, means for adjustably mounting at least one of said projections on said rigid structure so that the extent of its projections from said rigid structure can be varied, a flexible member extending between said ends of said projections, and inflatable means mounted between said flexible member and said sealing edge, said flexible member and said inflatable means functioning to push those portions of said sealing edge which extends between said ends of said projections against said submerged surface; and means cooperating with the enclosure for enabling manipulation of objects within said liquid free environment from outside said environment.

10. Apparatus for providing a substantially liquid free working environment on a submerged surface comprising:

a liquid impervious enclosure for defining said liquid free working environment in conjunction with said submerged surface, said enclosure including a rigid structure and a deformable, liquid impervious surface;

a sealing edge connected to said deformable liquid impervious surface for forming a liquid proof seal with said submerged surface;

means for altering the shape of said apparatus so that said sealing edge can form a seal with submerged surfaces of different shape, said shape altering means including a plurality of sealing edge supporting projections mounted on said rigid structure and having ends which project from said rigid structure for pushing said sealing edge against said submerged surface, means for adjustably mounting at least one of said projections on said rigid structure so that the extent of its projection from said rigid structure can be varied, a flexible member extending between said ends of said projections, and inflatable means mounted between said flexible member and said sealing edge, said flexible member and said inflatable means functioning to push those portions of said sealing edge which extends between said ends of said projections against said submerged surface; and at least one liquid impervious glove extending into, and forming a liquid proof seal with, said enclosure for enabling manipulation of objects within said liquid free environment from outside said environment.

11. Apparatus for providing a substantially liquid free working environment on a submerged surface comprising:

a rigid, liquid impervious enclosure for defining said liquid free working environment in conjunction with said submerged surface, a substantial portion of said enclosure being transparent;

a sealing edge for forming a liquid proof seal with said submerged surface;

a deformable, liquid impervious surface forming a liquid proof barrier between said rigid enclosure and said sealing edge;

a plurality of sealing edge supporting projections mounted on said rigid enclosure and having ends which project away from said rigid enclosure for pushing said sealing edge against said submerged surface, and means for adjustably mounting at least one of said projections on said rigid enclosure so that the extent of its projection from said rigid enclosure can be varied; and means cooperating with the enclosure for enabling manipulation of objects within said liquid free environment from outside said environment.

12. Apparatus for providing a substantially liquid free working environment on a submerged surface comprising:

a rigid, liquid impervious enclosure for defining said liquid free working environment in conjunction with said submerged surface;

a sealing edge for forming a liquid proof seal with said submerged surface;

a deformable, liquid impervious surface forming a liquid proof barrier between said rigid enclosure and said sealing edge; and a plurality of sealing edge supporting projections mounted on said rigid enclosure and having ends which project away from said rigid enclosure for pushing said sealing edge against said submerged surface, and means for adjustably mounting at least one of said projections on said rigid enclosure so that the extent of its projection from said rigid enclosure can be varied;

wherein said enclosure has an opening for enabling manipulation of objects within said liquid free environment from outside said environment.

13. Apparatus for providing a substantially liquid free working environment on a submerged surface comprising:

a rigid, liquid impervious enclosure for defining said liquid free working environment in conjunction with said submerged surface;

a sealing edge for forming a liquid proof seal with said submerged surface;

a deformable, liquid impervious surface forming a liquid proof barrier between said rigid enclosure and said sealing edge;

a plurality of sealing edge supporting projections mounted on said rigid enclosure and having ends which project away from said rigid enclosure for pushing said sealing edge against said submerged surface; and means for adjustably mounting at least one of said projections on said rigid enclosure so that the extent of its projection from said rigid enclosure can be varied;

wherein said enclosure has liquid tight doors which can be opened for enabling manipulation of objects within said liquid free environment from outside said environment.

14. Apparatus for providing a substantially liquid free working environment on a submerged surface comprising:

a rigid, liquid impervious enclosure for defining said liquid free working environment in conjunction with said submerged surface;

a sealing edge for forming a liquid proof seal with said submerged surface;

a deformable, liquid impervious surface forming a liquid proof barrier between said rigid enclosure and said sealing edge;

a plurality of sealing edge supporting projections mounted on said rigid enclosure and having ends which project away from said rigid enclosure for pushing said sealing edge against said submerged surface;

means for adjustably mounting at least one of said projections on said rigid enclosure so that the extent of its projection from said rigid enclosure can be varied;

at least one edge supporting member which is connected to said sealing edge and movably mounted on one of said ends of said projections for extending at least partially between said one end and at least one other of said ends and for pushing a portion of said sealing edge which extends between said ends against said submerged surface; and means for enabling manipulation of objects within said liquid free environment from outside said environment.

15. Apparatus according to claim 14, wherein said means for adjustably mounting at least one of said projections includes means for fixing the variable extent of said projection once said enclosure has obtained a desired shape for sealing with a given submerged surface.

16. Apparatus according to claim 14; wherein a substantial portion of said rigid enclosure is transparent.

17. Apparatus according to claim 14; wherein there is one said edge supporting member attached to each of said projections so that a major portion of the whole length of said sealing edge is supported by said edge supporting members.

18. Apparatus for providing a substantially liquid free working environment on a submerged surface comprising:

a rigid, liquid impervious enclosure for defining said liquid free working environment in conjunction with said submerged surface;

a sealing edge for forming a liquid proof seal with said submerged surface;

a deformable, liquid impervious surface forming a liquid proof barrier between said rigid enclosure and said sealing edge;

a plurality of sealing edge supporting projections mounted on said rigid enclosure and having ends which project away from said rigid enclosure for pushing said sealing edge against said submerged surface;

means for adjustably mounting at least one of said projections on said rigid enclosure so that the extent of its projection from said rigid enclosure can be varied; and at least one edge supporting member which is connected to said sealing edge and movably mounted on one of said ends of said projections for extending at least partially between said one end and at least one other of said ends and for supporting a portion of said sealing edge which extends between said ends;

an inflatable tube mounted between said supporting member and said sealing edge for pushing said sealing edge against said submerged surface; and means for enabling manipulation of objects within said liquid free environment from outside said environment.

19. Apparatus according to claim 18; wherein there is one said edge supporting member attached to each of said projections and wherein said inflatable tube extends substantially the whole length of said sealing edge, is mounted between each of said supporting members and said sealing edge, and is supported between said supporting members by a flexible member which extends between each of said supporting members.

20. Apparatus for providing a substantially liquid free working environment on a submerged surface comprising:

a rigid, liquid impervious enclosure for defining said liquid free working environment in conjunction with said submerged surface;

a sealing edge for forming a liquid proof seal with said submerged surface;

a deformable liquid impervious surface forming a liquid proof barrier between said rigid enclosure and said sealing edge;

a plurality of sealing edge supporting projections mounted on said rigid enclosure and having ends which project away from said rigid enclosure for pushing said sealing edge against said submerged surface;

means for adjustably mounting at least one of said projections on said rigid enclosure so that the extent of its projections from said rigid enclosure can be varied;

at least one edge supporting member which is movably mounted on one of said ends of said projections for extending at least partially between said one end and at least one other of said ends and for supporting a portion of said sealing edge which extends between said ends;

an inflatable tube mounted between said supporting member and said sealing edge for pushing said sealing edge against said submerged surface; and at least one liquid impervious glove extending into, and forming a liquid proof seal with, said enclosure for enabling manipulation of objects within said liquid free environment from outside said environment.

21. Apparatus for providing a substantially liquid free working environment on a submerged surface comprising:

a liquid impervious enclosure for defining said liquid free working environment in conjunction with said submerged surface;

a sealing edge located on said enclosure for forming a liquid proof seal with said submerged surface;

inflatable means connected to said enclosure for altering the shape of said apparatus by pushing said sealing edge against said submerged surface so that said sealing edge can form a seal with submerged surfaces of different shape; and means for enabling manipulation of objects within said liquid free environment from outside said environment.

22. Apparatus for providing a substantially liquid free working environment on a submerged surface comprising:

a liquid impervious enclosure for defining said liquid free working environment in conjunction with said submerged surface;

a sealing edge located on said enclosure for forming a liquid proof seal with said submerged surface;

an inflatable tube located between said enclosure and said sealing edge for altering the shape of said apparatus by pushing said sealing edge against said submerged surface so that said sealing edge can form a seal with submerged surfaces of different shape; and means for enabling manipulation of objects within said liquid free environment from outside said environment.

23. Apparatus for providing a substantially liquid free working environment on a submerged surface comprising:

a liquid impervious enclosure for defining said liquid free working environment in conjunction with said submerged surface;

a sealing edge located on said enclosure for forming a liquid proof seal with said submerged surface;

means for altering the shape of said apparatus so that said sealing edge can form a seal with submerged surfaces of different shape; and at least one liquid impervious glove extending into, and forming a liquid proof seal with, said enclosure for enabling manipulation of objects within said liquid free environment from outside said environment.

24. Apparatus for providing a substantially liquid free working environment on a submerged surface comprising:

a liquid impervious enclosure for defining said liquid free working environment in conjunction with said submerged surface;

a sealing edge located on said enclosure for forming a liquid proof seal with said submerged surface;

inflatable means connected to said enclosure for altering the shape of said apparatus by pushing said sealing edge against said submerged surface so that said sealing edge can form a seal with submerged surfaces of different shape; and at least one liquid impervious glove extending into, and forming a liquid proof seal with, said enclosure for enabling manipulation of objects within said liquid free environment from outside said environment.

25. Apparatus for providing a substantially liquid free working environment on a submerged surface comprising:

a liquid impervious enclosure for defining said liquid free working environment in conjunction with said submerged surface, a substantial portion of said enclosure being transparent;

a sealing edge located on said enclosure for forming a liquid proof seal with said submerged surface;

means for altering the shape of said apparatus so that said sealing edge can form a seal with submerged surfaces of different shape; and means for enabling manipulation of objects within said liquid free environment from outside said environment.

26. Apparatus for providing a substantially liquid free working environment on a submerged surface comprising:

a rigid, liquid impervious box for defining said liquid free environment in conjunction with said submerged surface, said box having side walls and corners at which said side walls meet, said side walls having edges defining an opening for facing said submerged surface, said edges being concave so that when said opening faces said submerged surface said corners form projections toward said surface and the portion of said edges between said corners are recessed away from said surface;

a sealing edge for forming a liquid proof seal with said submerged surface, said sealing edge being supported by the corner projections of said side walls;

a deformable, liquid impervious surface forming a liquid proof barrier between said side walls and said sealing edge;

a flexible member extending between said corner projections and connected to said sealing edge for supporting said sealing edge between said corner projections;

at least one adjustable projection mounted on each of said side walls to project by an adjustable extent between said corner projections for supporting said flexible member between said corner projections; and means for enabling manipulation of objects within said liquid free environment from outside said environment.

27. Apparatus for providing a substantially liquid free working environment on a submerged surface comprising:

a rigid, liquid impervious box for defining said liquid free working environment in conjunction with said submerged surface, said box having four side walls and one back wall generally perpendicular to each of said side walls, a substantial portion of said walls being transparent;

a sealing edge for forming a liquid proof seal with said submerged surface;

a deformable liquid impervious surface forming a liquid proof barrier between said four side walls and said sealing edge;

a plurality of sealing edge supporting rods each having ends which project away from said box for pushing said sealing edge against said submerged surface;

means for slidably mounting each of said rods on said box so that the extent of its projection from said box can be varied;

set screws for fixing the extent of projection of each of said slidably mounted rods at a desired value;

a plurality of edge supporting members, one of which is pivotally mounted on the ends of each of said rods which project away from said box for supporting portions of said sealing edge which extend between said ends of said rods;

an inflatable tube mounted between said supporting members and said sealing edge for pushing said sealing edge against said submerged surface; and a pair of liquid impervious gloves extending into said box and forming a liquid proof seal with one of the walls of said box for enabling manipulation of objects within said box from outside of it.

* * * * *